US006796621B2

(12) United States Patent
Choi et al.

(10) Patent No.: US 6,796,621 B2
(45) Date of Patent: Sep. 28, 2004

(54) OUTDOOR UNIT HAVING REINFORCING STRUCTURE FOR AIR CONDITIONER

(75) Inventors: Chang-Min Choi, Seoul (KR); Il-Kwon Oh, Seoul (KR)

(73) Assignee: LG Electronics Inc., Seoul (KR)

( * ) Notice: Subject to any disclaimer, the term of this patent is extended or adjusted under 35 U.S.C. 154(b) by 29 days.

(21) Appl. No.: 10/286,878

(22) Filed: Nov. 4, 2002

(65) Prior Publication Data

US 2003/0122458 A1 Jul. 3, 2003

(30) Foreign Application Priority Data

Dec. 28, 2001 (KR) ..... 2001-0087396

(51) Int. Cl.[7] ..... A47B 81/00
(52) U.S. Cl. ..... 312/100; 312/236
(58) Field of Search ..... 312/100, 265.4, 312/236; 52/291, 653.1, 656.1; 62/297; 165/47, 67; 248/351, 300, 200

(56) References Cited

U.S. PATENT DOCUMENTS 1,355,462 A * 10/1920 Edward ..... 248/300
1,358,322 A * 11/1920 McIntosh ..... 248/300
2,696,644 A * 12/1954 De Graw ..... 52/223.6
2,722,721 A * 11/1955 Carlow ..... 52/291
4,261,418 A * 4/1981 Helt et al. ..... 165/134.1
4,585,129 A * 4/1986 Lundqvist ..... 211/189
5,588,724 A * 12/1996 Emery ..... 312/236

* cited by examiner

*Primary Examiner*—Milton Nelson, Jr.
(74) *Attorney, Agent, or Firm*—Birch, Stewart, Kolasch & Birch, LLP

(57) ABSTRACT

An outdoor unit for an air conditioner having a reinforcing structure is disclosed. The outdoor unit comprises a base plate arranged at a bottom portion of a body of the outdoor unit; an upper plate arranged at an upper portion of a body of the outdoor unit; a plurality of support members connected between the base plate and the upper plate and arranged towards a circumference of the body with predetermined intervals; and a reinforcing member arranged between the support members for supporting the body of the outdoor unit, wherein the reinforcing member includes an upper reinforcing rod connected to both sides of the upper plate and prolonged to a lower direction; a lower reinforcing rod connected to both sides of the base plate and prolonged to an upper direction; and a connection reinforcing rod connected between the upper and lower reinforcing rods, thereby simplifying a construction of the reinforcing member which increases an intensity of the body of the outdoor unit and reduces a vibration. According to this, fabricating processes are simplified and a fabrication cost is minimized.

5 Claims, 5 Drawing Sheets

OUTDOOR UNIT HAVING REINFORCING STRUCTURE FOR AIR CONDITIONER

This nonprovisional application claims priority under 35 U.S.C. § 119(a) on Patent Application No. 2001-0087396 filed in KOREA on Dec. 28, 2001, which is herein incorporated by reference.

BACKGROUND OF THE INVENTION

1. Field of the Invention

The present invention relates to an outdoor unit for an air conditioner, and particularly, to an outdoor unit for an air conditioner having a reinforcing structure which increases a supporting intensity to reduce a vibration and to minimize a fabrication cost.

2. Description of the Background Art

Generally, an air conditioner is an apparatus for maintaining an indoor environment to be the most profitable state by conditioning a temperature, humidity, cleanliness of air and air flow.

A general refrigerating cycle includes a compressor for changing a refrigerant into gas of a high temperature and a high pressure from gas of a low temperature and a low pressure; a condenser for condensing the gaseous refrigerant compressed from the compressor into a liquid state and for emitting heat outside; an expander having a capillary tube for changing the liquid refrigerant changed from the compressor into a saturated liquid state of a low temperature and a low pressure; and an evaporator for evaporating the saturated liquid changed from the expander into a gaseous state of a low pressure and for absorbing exterior heat.

The general air conditioner using the refrigerating cycle is divided into an outdoor unit including the compressor and the condenser and an indoor unit including the compressor, the condenser, and the evaporator. The outdoor unit and the indoor unit are connected to each other by a connecting pipe.

When a large cooling capacity is required, the outdoor unit for an air conditioner has to increase its size, a large fan is installed therein, and is used a structure that a fan is arranged to an upper portion of the outdoor unit so as to suck air at a circumference of the outdoor unit and to exhaust the air to the upper portion of the outdoor unit.

Referring to FIGS. 1 and 2, an outdoor unit for an air conditioner in accordance with the conventional art will be explained.

FIG. 1 is a perspective view showing an outdoor unit for an air conditioner in accordance with the conventional art, and FIG. 2 is a sectional view taken along line II—II of FIG. 1.

Referring to FIGS. 1 and 2, the outdoor unit for an air conditioner in accordance with the conventional art comprises a case 11 forming a receiving space therein and provided with an inlet 16 and an outlet 15 for sucking and exhausting air; a compressor 32 installed at an inner side of the case 11 for compressing a refrigerant; a fan 36 installed with a predetermined distance from the compressor 32 and rotated by a rotating force of a motor 33 for sucking and exhausting air; and a condenser 34 installed at a circumference of the case 11 for emitting heat from the refrigerant compressed from the compressor 32 and for condensing the refrigerant into a liquid state.

The case 11 includes a base plate 12 installed at a bottom portion so as to install components such as the compressor 32 and etc.; an upper plate 14 installed above the base plate 12 with a predetermined distance and provided with an inlet 16 therebetween; and a plurality of support members 20 connected between the base plate 12 and the upper plate 14 and arranged with predetermined intervals towards a circumference direction of the case 11.

The upper plate 14 has at least one outlet 15 for exhausting air, and the outlet 15 is provided with a grill 17 for protecting the fan 36 from outside.

The plurality of support members 20 are arranged towards an outer circumference direction of the upper plate 14 and the base plate 12, thereby supporting the case 11.

Operations of the outdoor unit for an air conditioner in accordance with the conventional art will be explained.

First, if the compressor 32 is driven, a refrigerant compressed from the compressor 32 emits heat by passing the condenser 34. At this time, the fan 36 promotes the emission of the refrigerant by sucking exterior air through the inlet 16.

Also, the refrigerant emitted from the condenser 34 is reduced in a pressure and expanded through the expander (not shown) formed with a capillary tube and provided to the indoor unit (not shown). Then, the refrigerant is compressed in the compressor 32 again, and repeats the cycle.

The outdoor unit for an air conditioner is provided with a large fan and a compressor to enhance condense and evaporation efficiencies, thereby generating a noise and a vibration when the fan and the compressor are driven.

Moreover, if sizes of the compressor and the fan are increased to enhance a cooling capacity, a size of the outdoor unit for an air conditioner is also increased. At this time, when the compressor and the fan are driven, a supporting intensity of the outdoor unit is relatively weakened, so that a gap and a vibration are generated.

Accordingly, to overcome said problems, as shown in FIG. 3, a lattice-type sash composed of a plurality of vertical rods 52 and a plurality of horizontal rods 54 is installed at an outer side of the outdoor unit so as to prevent the vibration.

However, the outdoor unit for an air conditioner having the lattice-type sash 50 requires many components to fabricate the sash 50, complicated processes, and an expensive production cost.

SUMMARY OF THE INVENTION

Therefore, an object of the present invention is to provide an outdoor unit for an air conditioner having a reinforcing structure which increases a supporting intensity, simplifies a construction and a fabrication, and reduces a fabrication cost.

To achieve these and other advantages and in accordance with the purpose of the present invention, as embodied and broadly described herein, there is provided an outdoor unit for an air conditioner having a reinforcing structure comprising a base plate arranged at a bottom portion of a body of the outdoor unit, an upper plate arranged at an upper portion of the body of the outdoor unit, a plurality of support members connected between the base plate and the upper plate and arranged towards a circumference of the body with predetermined intervals, and a reinforcing member arranged between the support members for supporting the body of the outdoor unit, wherein the reinforcing member includes an upper reinforcing rod connected to both sides of the upper plate and prolonged to a lower direction, a lower reinforcing rod connected to both sides of the base plate and prolonged to an upper direction, and a connection reinforcing rod connected between the upper and lower reinforcing rods.

To achieve these and other advantages and in accordance with the purpose of the present invention, as embodied and broadly described herein, there is provided an outdoor unit for an air conditioner having a reinforcing structure, wherein the upper reinforcing rod consists of first and second upper rods connected to each other by fixing one side thereof to the upper plate respectively and by being prolonged to a lower direction with a predetermined angle, and the lower reinforcing rod consists of first and second lower rods connected to each other by fixing one side thereof to the base plate respectively and by being prolonged to an upper direction with a predetermined angle.

To achieve these and other advantages and in accordance with the purpose of the present invention, as embodied and broadly described herein, there is provided an outdoor unit for an air conditioner having a reinforcing structure, wherein the first and second upper rods and the first and second lower rods have a declined angle of 30° for the upper plate and the base plate respectively.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

An outdoor unit for an air conditioner having a reinforcing structure will be explained with reference to the attached drawings.

Figure 1:
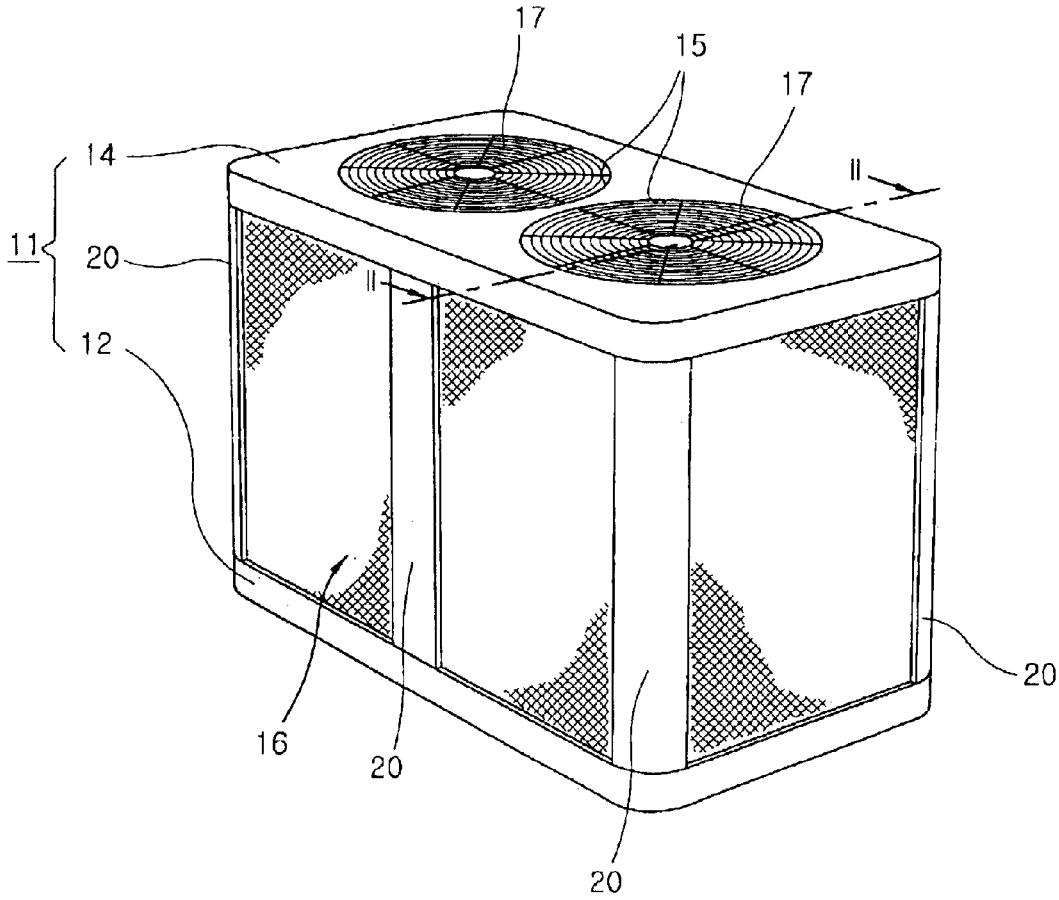
FIG. 1 CONVENTIONAL ART
FIG. 1 is a perspective view showing an outdoor unit for an air conditioner in accordance with the conventional art.
Figure 2:
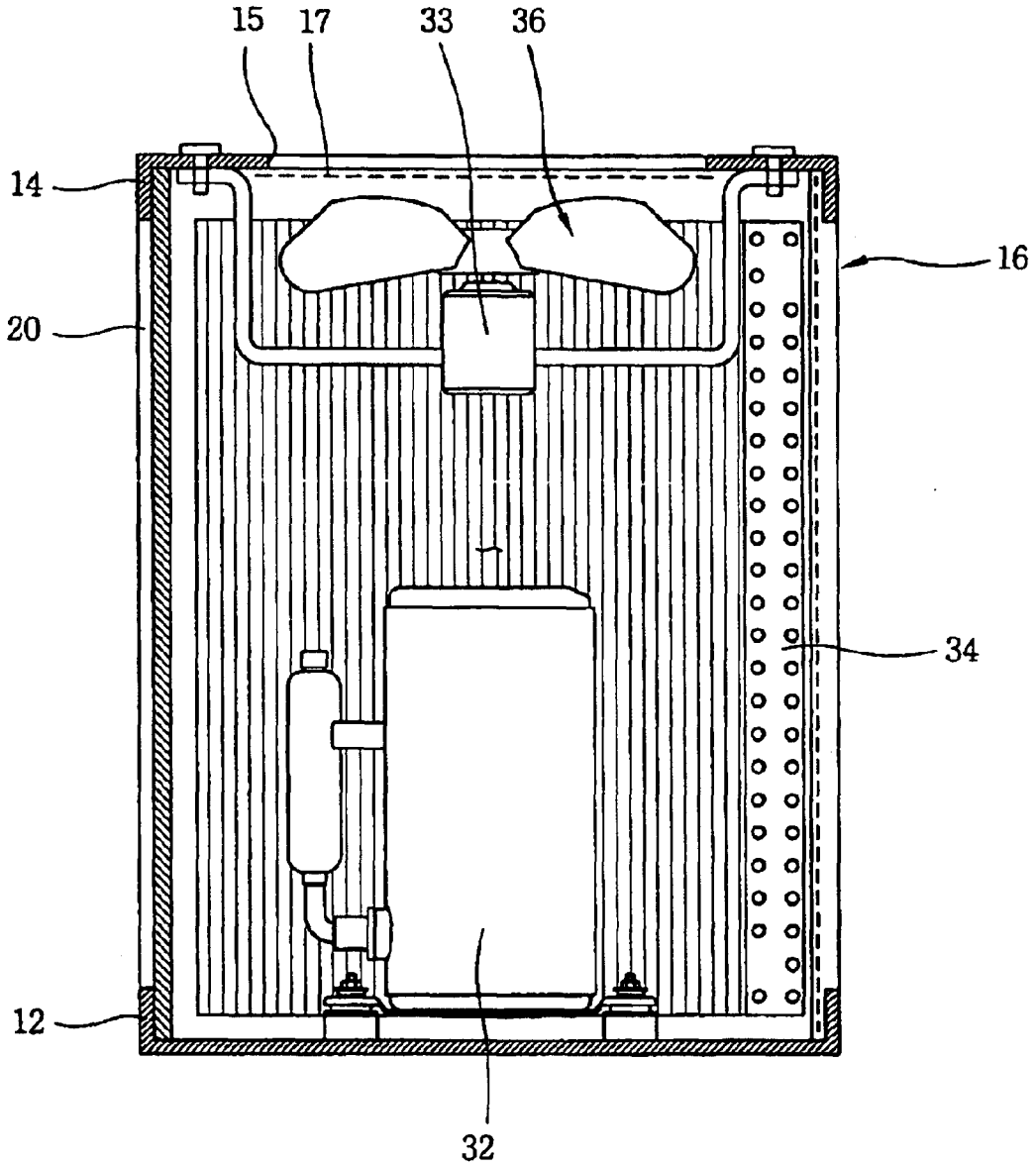
FIG. 2 CONVENTIONAL ART
FIG. 2 is a sectional view taken along line II—II of FIG. 1.
Figure 3:
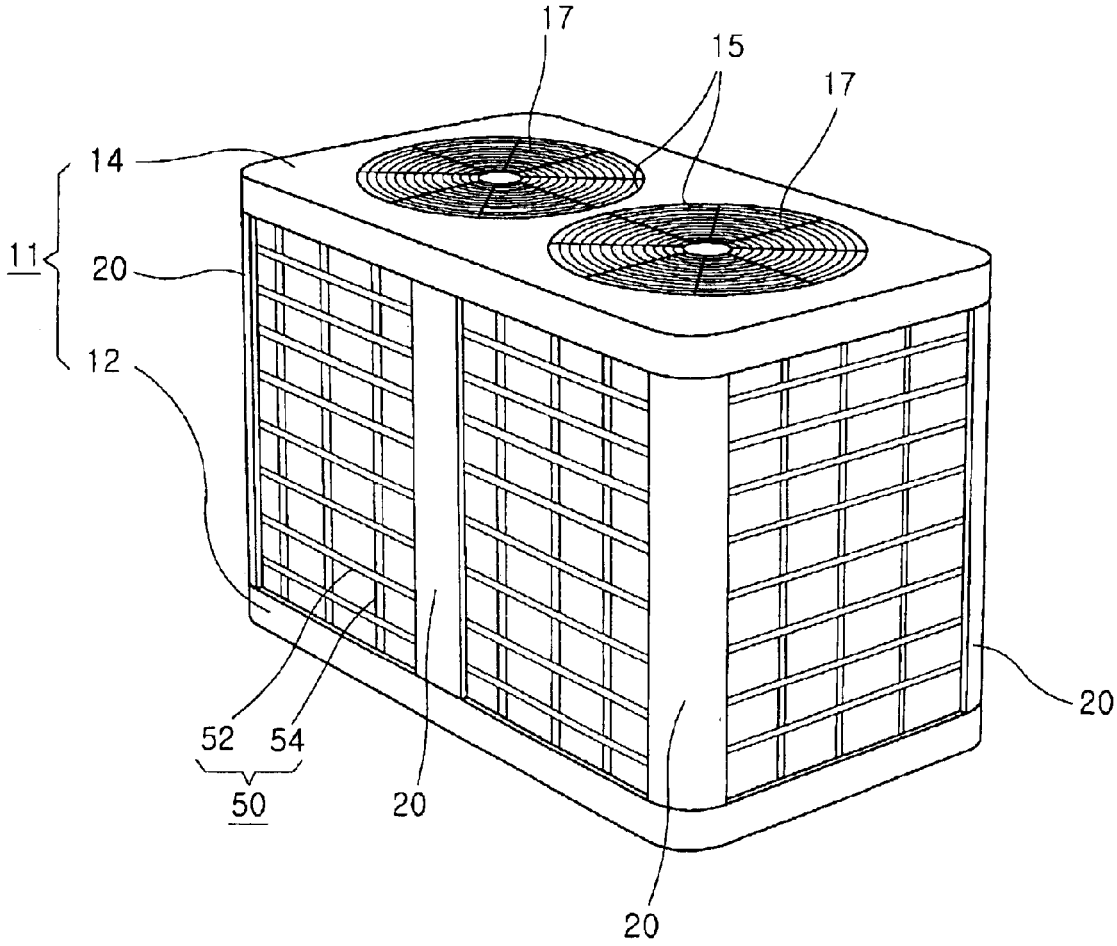
FIG. 3 CONVENTIONAL ART
FIG. 3 is a perspective view showing a state that a reinforcing sash is installed in an outdoor unit for an air conditioner in accordance with the conventional art.
Figure 4:
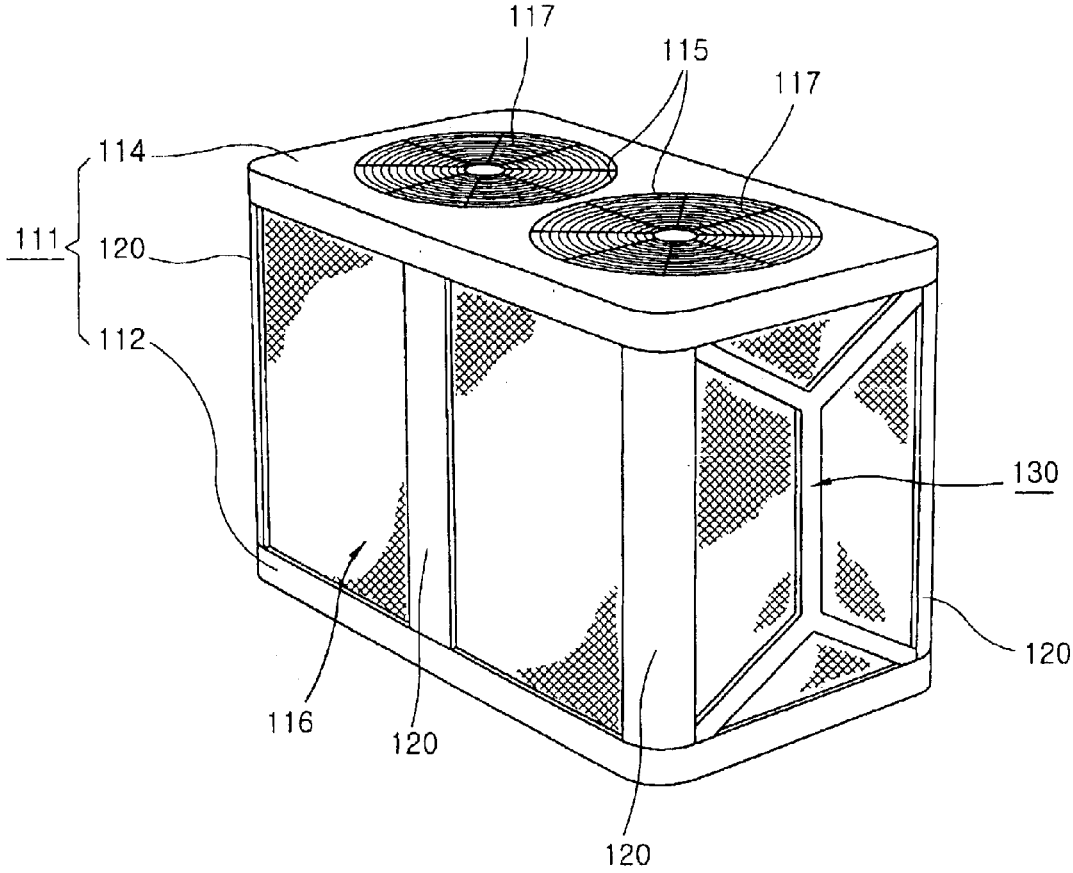
FIG. 4 is a perspective view of an outdoor unit for an air conditioner according to one embodiment of the present invention.
Figure 5:
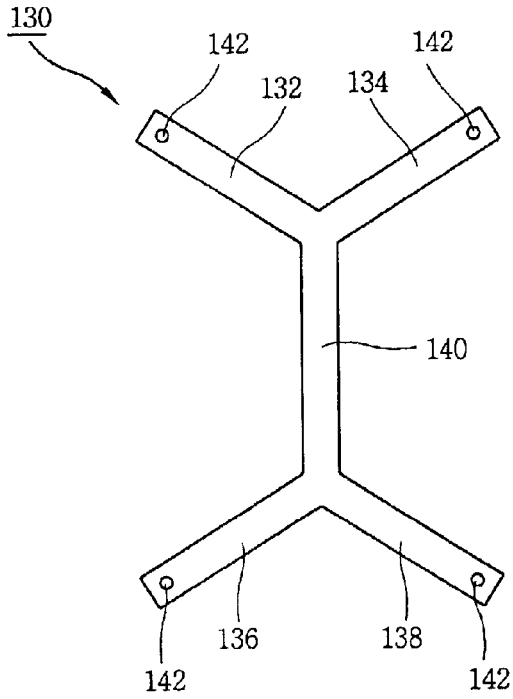
FIG. 5 is a frontal view showing the reinforcing member of FIG. 4.

FIG. 4 is a perspective view of an outdoor unit for an air conditioner according to one embodiment of the present invention, and FIG. 5 is a frontal view showing the reinforcing member of FIG. 4.

The outdoor unit for an air conditioner according to embodiments of the present invention comprises a case provided with an inlet and an outlet for sucking and exhausting air, a compressor installed at an inner side of the case for compressing a refrigerant, a fan rotated by a rotating force of a motor for sucking and exhausting air, and a condenser arranged at a circumference of the case for emitting heat from the refrigerant compressed from the compressor and for condensing the refrigerant into a liquid state.

The case 111 includes a base plate 112 installed at a bottom portion of the outdoor unit; an upper plate 114 installed above the base plate 112 with a predetermined distance and provided with an inlet 116 therebetween; and a plurality of support members 120 connected between the base plate 112 and the upper plate 114 and arranged with predetermined intervals towards a circumference direction of the body.

The upper plate 114 has at least one outlet 115 for exhausting air, and the outlet 115 is provided with a grill 117 protecting the outlet 115 from outside.

The outdoor unit for an air conditioner has a similar or the same construction with that of the conventional art.

However, in the present invention, further provided is a reinforcing member 130 for increasing a supporting intensity of the outdoor unit by being fixed between the support members 120 formed towards an outer circumference direction of the outdoor unit.

Referring to FIG. 5, the reinforcing member will be explained in more detail.

The reinforcing member 130 includes a first upper rod 132 fixed at the upper plate 114 and prolonged towards a lower direction with a predetermined angle, a second upper rod 134 fixed at the upper plate 114 with a predetermined interval from the first upper rod 132 and prolonged towards a lower direction to be connected to the first upper rod 132, a first lower rod 136 fixed at the base plate 112 and prolonged towards an upper direction with a predetermined angle, a second lower rod 138 fixed at the base plate 112 with a predetermined interval from the first lower rod 136 and prolonged towards an upper direction to be connected to the first lower rod 136, and a connection rod 140 engaged to ends of the first and second upper rods 132 and 134 and prolonged towards a lower direction to be connected to the first and second lower rods 136 and 138.

The first and second upper rods 132 and 134 are respectively fixed to a part to which the upper plate 114 and upper ends of the support members 120 are engaged, and the first and second lower rods 136 and 138 are respectively fixed to a part to which the base plate 112 and lower ends of the support members 120 are engaged.

Ends of the first and second upper rods 132 and 134 and the first and second lower rods 136 and 138 are respectively provided with screw holes 142 penetrating therein so as to fix the rods to the support members 120, the upper plate 114, and the base plate 112 by a screw (not shown).

Meanwhile, the first and second upper rods 132 and 134, and the first and second lower rods 136 and 138 can be fixed to the first and second support members 121 and 122, the upper plate 114, and the base plate 112 by welding.

At this time, to minimize a length of the reinforcing member 130, it is desirable that the first and second upper rods 132 and 134 and the first and second lower rods 136 and 138 respectively have a declined angle of 30° for the upper plate 114 and the base plate 112.

A relation between a length of the reinforcing member 130 and the declined angle will be explained with reference to FIG. 6.

Figure 6:
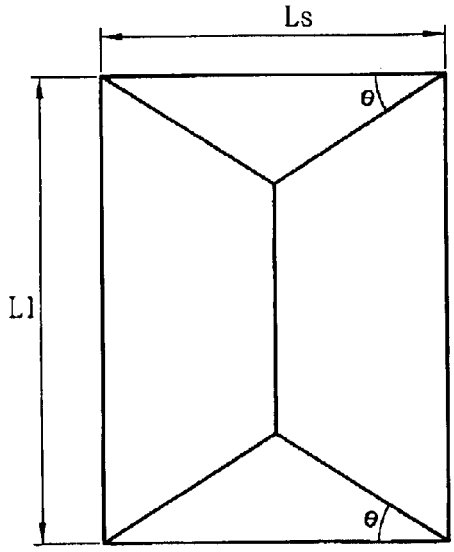
FIG. 6 is an explanation view for yielding a minimum length of the reinforcing member of FIG. 5.

FIG. 6 is an explanation view for yielding a minimum length of the reinforcing member of FIG. 5.

As shown in FIG. 6, a length of the reinforcing member 130 calculated by connecting each vertex of a rectangle having two long lines (Ll) and two short lines (Ls) will be shown as follows.

A length of the reinforcing member=Ll+Ls(2/cos θ−tan θ)

Wherein, in case of that a>b>0 and 0<θ<90°, it can be known that a declined angle (θ) that minimizes a length of the reinforcing member 130 is 30°.

That is, when an angle (θ) between the first and second upper rods 132 and 134 and the upper plate 114, and an angle (θ) between the first and second lower rods 136 and 138 and the base plate 112 are respectively 30°, the reinforcing member 130 has the shortest length, thereby reducing a weight of the reinforcing member 130 and reducing a fabrication cost.

Processes for fabricating the case of the outdoor unit for an air conditioner according to one embodiment of the present invention and effects thereof will be explained.

First, lower ends of the support members 120 and a lower end of the reinforcing member 130 are engaged at an outer circumference of the base plate 112.

Subsequently, each component is fixed to the base plate 112, then, the upper plate 114 is engaged to upper ends of the support members 120 and an upper end of the reinforcing member 130, thereby completing a fabrication.

The case of the outdoor unit for an air conditioner according to one embodiment of the present invention is provided with the reinforcing member composed of the first and second upper rods, the first and second lower rods, and the connection rod for connecting the rods to one another so as to connect upper ends and lower ends of a pair of support members arranged in parallel as a unit, thereby increasing a supporting intensity and then reducing a vibration.

Also, in the reinforcing member according to the present invention, since each rod makes an angle of 30° for the base plate and the upper plate when the upper ends and lower ends of a pair of support members arranged in parallel are connected to one another, the reinforcing member has the shortest length, thereby reducing a weight of the reinforcing member and reducing a fabrication cost.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An outdoor unit for an air conditioner having a reinforcing structure comprising:

a base plate arranged at a bottom portion of a body of the outdoor unit;

an upper plate arranged at an upper portion of the body of the outdoor unit;

a plurality of support members connected between the base plate and the upper plate and arranged towards a circumference of the body with predetermined intervals; and a reinforcing member arranged between the support members for supporting the body of the outdoor unit, wherein the reinforcing member includes an upper reinforcing rod connected to both sides of the upper plate and prolonged to a lower direction; a lower reinforcing rod connected to both sides of the base plate and prolonged to an upper direction; and a connection reinforcing rod connected between the upper and lower reinforcing rods.

2. The outdoor unit of claim 1, wherein the upper reinforcing rod consists of a first upper rod and a second upper rod connected to each other by fixing one side thereof to the upper plate respectively and by being prolonged to a lower direction with a predetermined angle, and the lower reinforcing rod consists of a first lower rod and a second lower rod connected to each other by fixing one side thereof to the base plate respectively and by being prolonged to an upper direction with a predetermined angle.

3. The outdoor unit of claim 2, wherein the first and second upper rods are respectively fixed to a part to which upper ends of the upper plate and the support members are engaged, and the first and second lower rods are respectively fixed to a part to which lower ends of the base plate and the support members are engaged.

4. The outdoor unit of claim 3, wherein the first and second upper rods and first and second lower rods respectively have a declined angle of 30° for the upper plate and the base plate.

5. The outdoor unit of claim 2, wherein the upper reinforcing rods, the lower reinforcing rods, and the connection reinforcing rod are formed as a unit.

* * * * *